US008607947B2

(12) United States Patent
Morszeck

(10) Patent No.: US 8,607,947 B2
(45) Date of Patent: Dec. 17, 2013

(54) INTERMEDIATE PLATE

(75) Inventor: Dieter Morszeck, Cologne (DE)

(73) Assignee: RIMOWA GmbH, Cologne (DE)

( * ) Notice: Subject to any disclaimer, the term of this patent is extended or adjusted under 35 U.S.C. 154(b) by 520 days.

(21) Appl. No.: 12/745,926

(22) PCT Filed: Oct. 23, 2008

(86) PCT No.: PCT/EP2008/062668
§ 371 (c)(1),
(2), (4) Date: Jun. 3, 2010

(87) PCT Pub. No.: WO2009/077215
PCT Pub. Date: Jun. 25, 2009

(65) Prior Publication Data

US 2010/0294607 A1 Nov. 25, 2010

(30) Foreign Application Priority Data

Dec. 18, 2007 (DE) ..... 20 2007 017 410 U

(51) Int. Cl.
*A45C 13/00* (2006.01)

(52) U.S. Cl.
USPC ..... 190/36; 190/109; 190/110

(58) Field of Classification Search
USPC ..... 190/36, 124, 102, 109, 110
See application file for complete search history.

(56) References Cited

U.S. PATENT DOCUMENTS

| | | | | |
|---|---|---|---|---|
| 159,248 | A * | 2/1875 | Coit | 190/36 |
| 586,296 | A * | 7/1897 | Thomas | 190/104 |
| 1,252,516 | A * | 1/1918 | Videgaray | 190/13 C |
| 1,389,595 | A * | 9/1921 | Phillips | 190/13 E |
| 2,738,041 | A * | 3/1956 | Mount Haes | 190/111 |
| 6,435,117 | B2 | 8/2002 | Hoberman | |
| 6,435,324 | B1 * | 8/2002 | Hoberman | 190/110 |
| 8,177,060 | B2 * | 5/2012 | Kim | 206/293 |

FOREIGN PATENT DOCUMENTS

| | | | |
|---|---|---|---|
| FR | 2 711 044 | A | 4/1995 |
| GB | 161 117 | A | 4/1921 |
| GB | 2076646 | * | 12/1981 |

OTHER PUBLICATIONS

International Search Report dated Jan. 7, 2009 to corresponding international patent application No. PCT/EP2008/062668 filed Oct. 23, 2008, 2 pages.

* cited by examiner

*Primary Examiner* — Tri Mai
(74) *Attorney, Agent, or Firm* — Maier & Maier, PLLC

(57) ABSTRACT

On a piece of luggage having at least one inner volume, which is delimited by at least one luggage wall and by at least one side wall protruding from said luggage wall, wherein the inner volume is divided by at least one intermediate plate, it is provided that at least one luggage strap is attached to the intermediate plate with a first end, the luggage strap is adjustably guided by means of at least one deflection device along the wall of the piece of luggage and at least two side wall sections that are disposed opposite each other such that the distance of the intermediate plate to the luggage wall can be adjusted in a variable way, and that the free second end of the luggage strap can also be fastened to the intermediate plate.

10 Claims, 2 Drawing Sheets

INTERMEDIATE PLATE

RELATED APPLICATIONS

Figure 1:
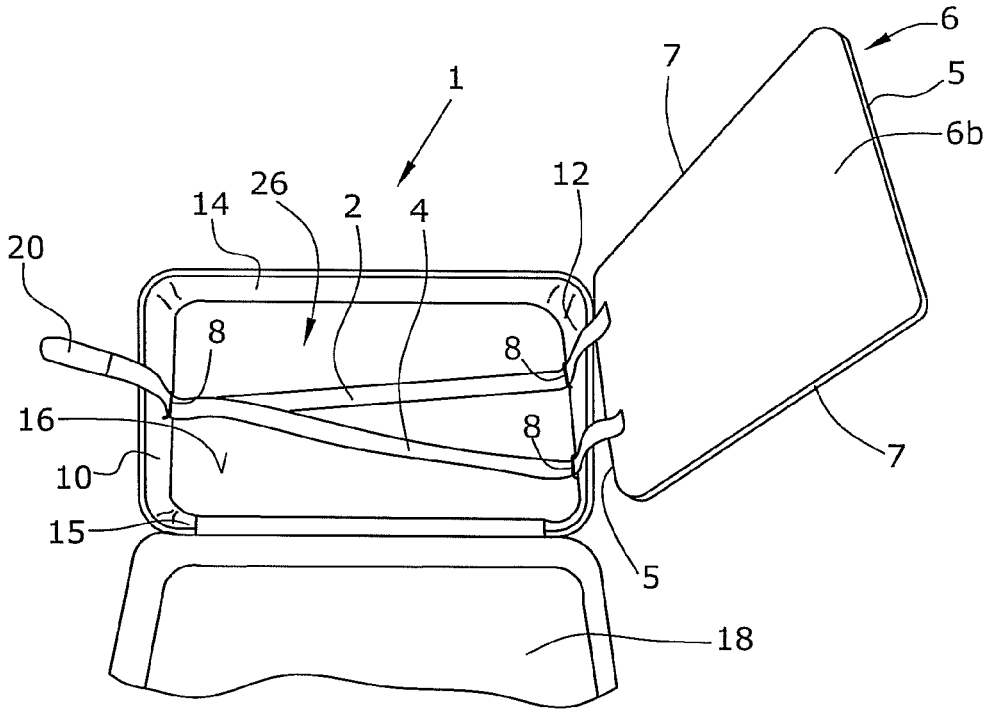

This application is the U.S. national stage application which claims priority under 35 U.S.C. §371 to international patent application No.: PCT/EP2008/062668, filed on Dec. 23, 2008, which claims priority under 35 U.S.C. §119, to German patent application No.: 20 2007 017 410.1, filed on Dec. 18, 2007, the disclosures of which are incorporated by reference herein their entireties.

The invention is directed to a luggage case as defined in the preamble of claim 1.

Such a luggage case, known from prior art, usually comprises a rear wall of the luggage case, a lid and four side walls that may be formed from a rigid or a flexible material. Further, such a luggage case may comprise an intermediate plate or, alternatively, luggage straps. Both the intermediate plate and the luggage straps used as an alternative are rigidly fixed to the rear wall or the lid or one or more of the side walls, for example. The intermediate plates are useful in dividing the interior volume of the luggage case. The luggage straps are useful in fixing the pieces of garment transported in a suitcase.

Such previously known luggage cases have as a drawback that, in a luggage case with an intermediate plate, the pieces of garment transported in the luggage case might be displaced if the inner space of the luggage case divided by the intermediate plate is not filled completely. Thus, the garments may become crinkled. The luggage cases with luggage straps, known from prior art, are disadvantageous in that the garments may be crinkled while being fixed with the luggage straps.

Thus, it is an object of the invention to provide a luggage case, wherein the inner space may be divided variably and a planar position of a suitcase's contents held by the intermediate plate is guaranteed.

The object is solved with the features of claim 1.

The invention advantageously provides that at least one luggage strap has a first end fastened to an intermediate plate, that the luggage strap is adjustably guided along a wall of the luggage case and at least two opposite side wall portions by means of at least one deflection means such that the distance of the intermediate plate to the wall of the luggage case can be adjusted variably, and that the free second end of the luggage strap may also be fastened to the intermediate plate. Preferably, the luggage strap has its first end permanently fixed to the intermediate plate. The luggage strap may be guided closely along the wall of the luggage case and/or the respective side wall portion along which the luggage strap runs.

This embodiment offers the advantage that the intermediate plate, which preferably extends in parallel with the wall of the luggage case, is not fastened immediately to the luggage case, whereby an optional distance between the wall of the luggage case and the intermediate plate can be adjusted variably. Thereby, the transported contents of the luggage case, e.g. garments, can be held in a certain position. The garments can be transported without being crinkled. A particular advantage is the variable division of the inner volume of the luggage case, so that, for example, an optional partial volume can be adjusted for different contents of the luggage case, such as files and garments.

It is an additional advantage that the luggage case can be divided very easily and quickly. A person can adjust the distance between the wall of the luggage case and the intermediate plate using only one hand.

A further advantage is that the intermediate plate can extend in parallel with the wall of the luggage case regardless of the volume of the luggage. However, depending on the contents of the luggage case, the intermediate wall may also be inclined with respect to the wall of the luggage case.

Preferably, the intermediate plate is rigid. Yet, it may also be made of a flexible material.

The at least one deflection means preferably redirects the luggage strap in the mutually opposite transition regions between the respective side wall portions and the adjoining wall of the luggage case. The wall of the luggage case may be the rear wall of the luggage case and/or the lid, for example.

This is advantageous in that the inner volume of the luggage case can be divided variably once or twice, given that a respective intermediate wall is provided for the rear wall of the luggage case and the lid.

The at least one deflection means may be formed by a guide channel through which the luggage strap is passed. The guide channel may extend from one side wall along the wall of the luggage case to the side wall opposite the first-mentioned side wall.

The advantage of the guide channel is that no friction can occur between the luggage strap and the contents of the luggage case while adjusting the luggage strap.

The luggage straps may alternatively be guided in at least two deflection means.

The deflection means may be loop-like deflection means. These deflection means are simple, economic parts that are easily mounted.

A quick-acting fastener may be used to removable fasten the luggage strap to the intermediate wall at one point. The quick-acting fastener may be a Velcro-type fastener, a snap fastener or a magnetic fastener. The Velcro-type fastener may be a strip, such as a Nylon strip, with hooks, where one end of the strip is fastened to an end of the luggage strap, and a strip with loops (e.g. a Nylon strip) fastened to the intermediate plate.

The intermediate plate extends in different selectable planes, preferably in parallel with the wall of the luggage case.

The variable fastening of the luggage strap may be realized, for example, by making the Nylon strip fastened to the intermediate plate rather long. Thus, the one end of the luggage strap can be fastened at different points on the intermediate wall.

Alternatively, with a snap fastener, for example, formed by a first and a second element that cooperate, a plurality of first elements may be fastened to the intermediate plate and a second element may be fastened to the luggage strap. As an alternative, a plurality of first elements could be fastened to the luggage strap and one second element could be fastened to the intermediate plate.

With a magnetic fastener a long magnet strip may be attached on the intermediate plate and the luggage strap may comprise a flexible strip of metal. As an alternative, the metal strip may be attached on the intermediate plate and the magnetic strip may be provided on the luggage strap.

The luggage straps 2, 4 form vertical sections 8 between the deflection means and the intermediate plate 6 that preferably extend parallel to the side walls 10, 12.

The length of the vertical sections of the luggage strap and thus the distance between the intermediate plate and the wall of the luggage case may adjustable by making the luggage strap displaceable with respect to the wall of the luggage case and allowing for an optional fastening of the luggage strap on the intermediate plate.

The luggage case may be a suitcase made from a rigid or a flexible material. The suitcase may be, for example, a suitcase of two suitcase shell halves or a suitcase made from or including textile material. Further, the suitcase may be a trolley, a pilot case, a briefcase, a travel bag, a beauty case or a backpack trolley, for example.

Figure 2:
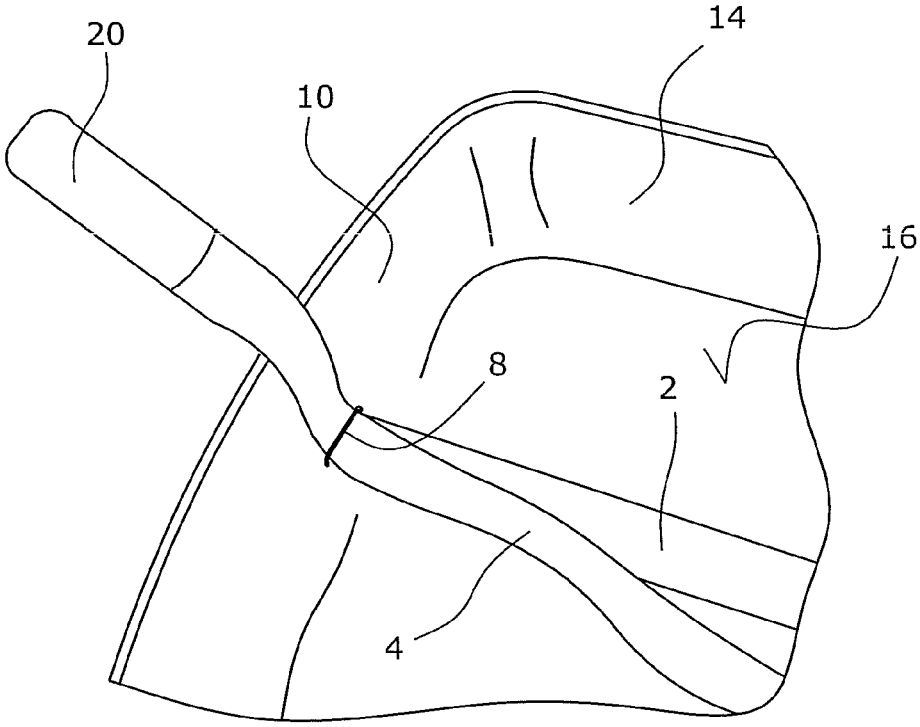
Figure 3:
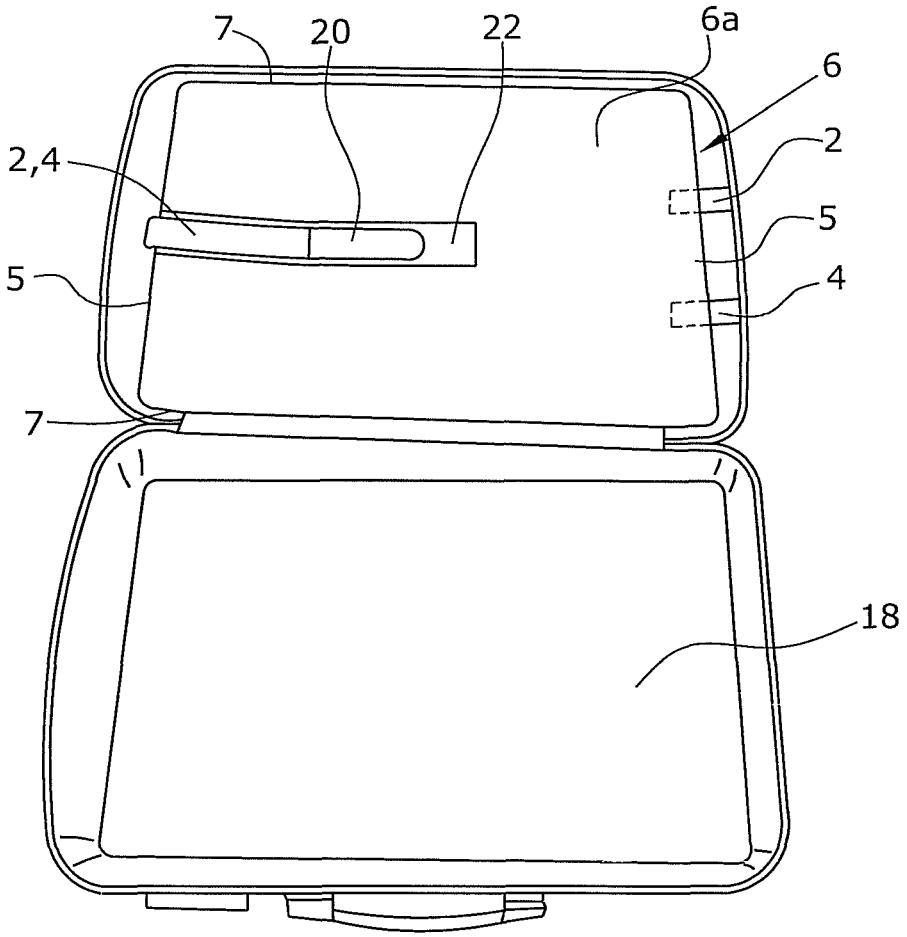

The following is a detailed description of an embodiment of the invention with reference to the accompanying drawings. The Figures schematically show:

FIG. 1 an open suitcase,

FIG. 2 a deflection means,

FIG. 3 a top plan view on the intermediate plate.

FIG. 1 is an exemplary illustration of a conventional type of suitcase. The open suitcase 1 has a wall 16 of the luggage case that forms a rear wall, four side walls 10, 12, 14, 15, a lid 18 and an intermediate plate 6. Two side walls 14, 15 form the longitudinal sides of the suitcase and are arranged opposite each other. The two other side walls 10, 12 form the two transverse sides of the suitcase and are also arranged opposite each other. The wall 16 of the luggage case, the lid 18 and the four side walls 10, 12, 14, 15 define the inner volume 26 of the suitcase 1.

The substantially rectangular intermediate plate 6 with two transverse sides 5 and two longitudinal sides 7 thereof has a bottom face 8*b* and a top face 6*a*. The transverse sides 5 of the intermediate plate extend in parallel with the transverse sides of the suitcase. The longitudinal sides of the intermediate plate are of the same length or slightly shorter than the longitudinal sides of the wall of the luggage case. Likewise, the transverse sides of the intermediate wall are of the same size or slightly smaller than the transverse side of the wall of the luggage case.

Two luggage straps 2, 4 are passed along the wall 16 of the luggage case and the adjacent side walls 10, 12 forming the transverse walls of the suitcase. The luggage strap 2, 4 run close to the wall 16 of the luggage case and the two opposite side walls 10, 12. A respective end of the two luggage straps 2, 4 is fastened to the bottom face 6*b* of the intermediate plate 6 near a transverse side 5 thereof that is close to the side wall 12. Preferably, the fastening is permanent. For example, the ends are sewn to the intermediate plate 6.

The luggage straps 2, 4 are guided in, preferably, three loop-like deflection means 8. The three loop-like deflection means 8 are located in the mutually opposite transition portions between the wall 16 of the luggage case and the side walls 10, 12 forming the transverse sides of the suitcase. Two of the three loop-like deflection means 8 are arranged in the transition portion between the wall 16 of the luggage case and the side wall 12, and one of the three loop-like deflection means 8 is situated in the transition portion between the wall 16 of the luggage case and the side wall 10.

The ends of the luggage straps 2, 4 that are near the side wall 10, are connected with each other, forming a combined end. The combined end of the luggage straps 2, 4 is guided by a deflection means 8 in the transition portion between the wall 16 of the luggage case and the adjacent side wall 10. A part of a Velcro-type fastener is provided at the end of the combined end of the luggage straps 2, 4. This part is a strip, preferably of Nylon, with hooks 20. The luggage straps 2, 4 may also be elastic.

FIG. 2 is an upscaled illustration of the deflection means 8 through which the common end of the luggage straps 2, 4 is passed. The deflection means 8 is fastened to the side wall 10 near the wall 16 of the luggage case.

The contents of the luggage may be placed on the wall 16 of the luggage case with the luggage straps 2, 4. Even with luggage items packed thereon, the luggage straps 2,4 are still displaceable along the wall of the luggage case. The bottom face 6*b* of the intermediate plate 6 is placed on the items packed so that the intermediate plate 6 preferably extends in parallel with the wall 16 of the luggage case.

The other part of the Velcro-type fastener 22 is fastened on the top face 6*a* of the intermediate plate 6. This part of the Velcro-type fastener is formed by a strip, preferably of Nylon, with loops 22. The Nylon strap with the loops 22 is arranged in parallel with the longitudinal sides 7 of the intermediate plate. The Nylon strip with the hooks 20, provided at the combined ends of the luggage straps 2, 4, may be attached at various places on the Nylon strip with loops. The luggage straps are redirected by the deflection means 8, on the one hand, and by the transverse sides of the luggage case, on the other hand. Thus, the luggage straps 2, 4 form vertical sections between the deflection means and the intermediate plate 6, which preferably extend in parallel with the side walls 10, 12. The fact that the luggage straps 2, 4 are displaceable with respect to the bottom plate 16 and that the combined end of the luggage straps 2, 4 with the Nylon strip with hooks 20 can be positioned at various positions on the Nylon strip with loops 22, makes it possible to vary the respective length of the vertical sections of the luggage straps 2, 4 running along the side walls 10, 12. Thereby, the distance between the intermediate plate 6 and the wall 16 of the luggage case can be adjusted. In this manner, the inner volume of the luggage case can be divided and a planar position of the suitcase's contents held by the intermediate plate 6 can be guaranteed.

The wall 16 of the luggage case in the embodiment described is rectangular in shape. Of course, the wall 16 of the luggage case, for example, may have a shape differing from a rectangular shape, e.g. a round shape.

The invention claimed is:

1. A luggage case comprising at least one inner volume defined by at least one wall of the luggage case and at least one side wall projecting from said wall of the luggage case, the inner volume being divided by at least one intermediate plate, wherein, at least one luggage strap is fastened with a first end to the intermediate plate, that the luggage strap is guided adjustably along the wall of the luggage case and at least two opposite side wall portions by means of at least one deflection means such that the distance of the intermediate plate to the wall of the luggage case can be adjusted variably, and that the free second end of the luggage strap may also be fastened to the intermediate plate by a quick-acting fastener, wherein a first part of the quick-acting fastener is fastened to the free second end of the luggage strap and a second part of the quick-acting fastener is fastened to the intermediate plate.

2. The luggage case of claim 1, wherein said luggage strap is guided closely along the wall of the luggage case and the respective side wall portion along which the luggage strap runs.

3. The luggage case of claim 1, wherein at least one deflection means redirects the luggage strap in the mutually opposite transition portions between the respective side wall portions and the adjoining wall of the luggage case.

4. The luggage case of claim 1, wherein at least one deflection means is formed by a guide channel through which the luggage strap is passed.

5. The luggage case of claim 1, wherein at least two deflection means guide the luggage strap.

6. The luggage case of claim 5, wherein the deflection means are formed by loop-like deflection means.

7. The luggage case of claim 1, wherein the luggage strap is removably fastened at the free second end by means of a quick-acting fastener.

8. The luggage case of claim 1, wherein the intermediate plate extends in different selectable planes, preferably in parallel with the wall of the luggage case.

9. The luggage case of claim 1, wherein the length of the portions of the luggage strap extending in parallel with the side wall portions and thus the distance between the intermediate plate and the wall of the luggage case is adjustable by the luggage strap being displaceable with respect to the wall of the luggage case and the position of the fastening of the luggage strap on the intermediate plate is optionally selectable.

10. A luggage case comprising at least one inner volume defined by at least one wall of the luggage case and at least one side wall projecting from said wall of the luggage case, the inner volume being divided by at least one intermediate plate, wherein at least one luggage strap is fastened with a first end to the intermediate plate, that the luggage strap is guided adjustably along the wall of the luggage case and at least two opposite side wall portions by means of at least one deflection means such that the distance of the intermediate plate to the wall of the luggage case can be adjusted variably, and that the free second end of the luggage strap may also be fastened to the intermediate plate, wherein the luggage strap is removably fastened at the free second end by means of a quick-acting fastener, wherein a first part of the quick-acting fastener is fastened to the free second end of the luggage strap and a second part of the quick-acting fastener is fastened to the intermediate plate, wherein the fastener is a hook and loops-type fastener, a snap fastener or a magnetic fastener.

* * * * *

UNITED STATES PATENT AND TRADEMARK OFFICE

CERTIFICATE OF CORRECTION

PATENT NO. : 8,607,947 B2
APPLICATION NO. : 12/745926
DATED : December 17, 2013
INVENTOR(S) : Dieter Morszeck It is certified that error appears in the above-identified patent and that said Letters Patent is hereby corrected as shown below:

On the Title Page, (22), replace "PCT Filed: Oct. 23, 2008" with --PCT Filed: Sept. 23, 2008.--

Signed and Sealed this
Seventh Day of June, 2016

Michelle K. Lee

Michelle K. Lee
*Director of the United States Patent and Trademark Office*